US005412625A

United States Patent [19]

Duchek

[11] Patent Number: 5,412,625

[45] Date of Patent: May 2, 1995

[54] STRUCTURAL GRAPHIC DISPLAY

[76] Inventor: Donna Duchek, 625 Highway Circle Dr., Manchester, Mo. 63021

[21] Appl. No.: 475,233

[22] Filed: Feb. 5, 1990

[51] Int. Cl.[6] ..... G04B 19/00

[52] U.S. Cl. ..... 368/223; 368/228; 428/13; 428/912.2

[58] Field of Search ..... 40/219; 350/113, 286; 272/8 M, 8 N, 8.5; 428/912.2, 13; 359/833

[56] References Cited

U.S. PATENT DOCUMENTS

| | | | |
|---|---|---|---|
| 1,140,148 | 5/1915 | Furber . | |
| 2,114,711 | 4/1938 | Horinstein . | |
| 2,406,743 | 9/1946 | Crowson | 272/8 M |
| 3,520,588 | 7/1970 | Salyer et al. . | |
| 3,661,385 | 5/1972 | Schneider . | |
| 3,703,431 | 11/1972 | Kemper . | |
| 3,834,051 | 9/1974 | Barnes et al. . | |
| 3,867,013 | 2/1975 | Ashenfarb | 428/912.2 |
| 4,218,836 | 8/1980 | Acres . | |
| 4,268,985 | 5/1981 | Lecznar | 40/219 |
| 4,695,929 | 9/1987 | Smith . | |
| 4,799,764 | 1/1989 | Crowell . | |

FOREIGN PATENT DOCUMENTS

| | | | |
|---|---|---|---|
| 024525 | 12/1987 | European Pat. Off. | 428/13 |
| 2091926 | 8/1982 | United Kingdom | 40/219 |

*Primary Examiner*—Bernard Roskoski
*Attorney, Agent, or Firm*—Rogers, Howell & Haferkamp

[57] ABSTRACT

A structural graphic display has one or more first generally transparent surfaces with reversed images superposed thereon juxtaposed to a reflective surface such that the reversed image may be viewed as a reflection in the reflective surface. The display may be either purely an ornamental device, or may be utilized in lamps, desk accessories, greeting cards, or clocks as disclosed herein.

18 Claims, 4 Drawing Sheets

FIG. 9.

FIG. 7.
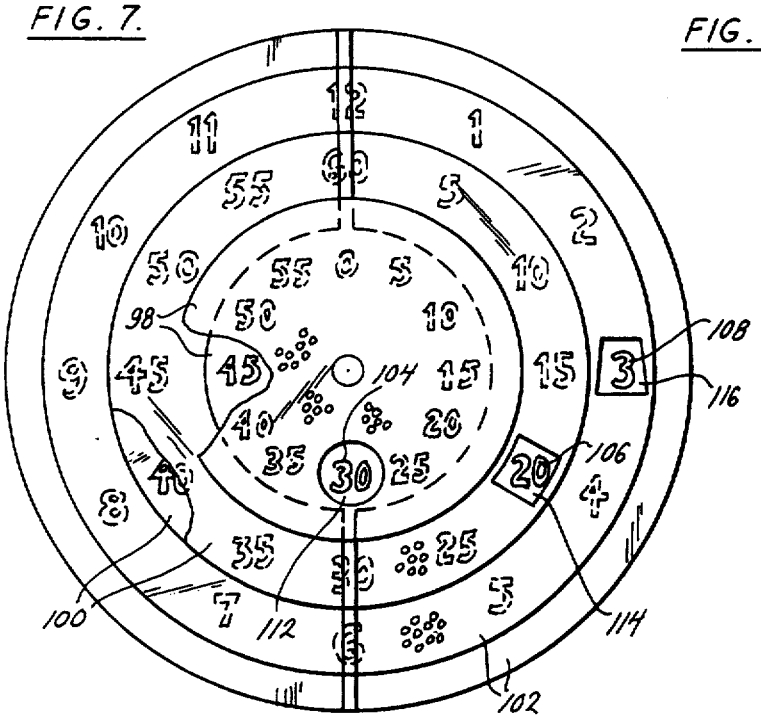
FIG. 8.
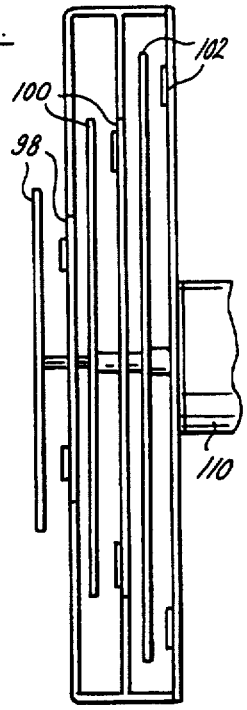
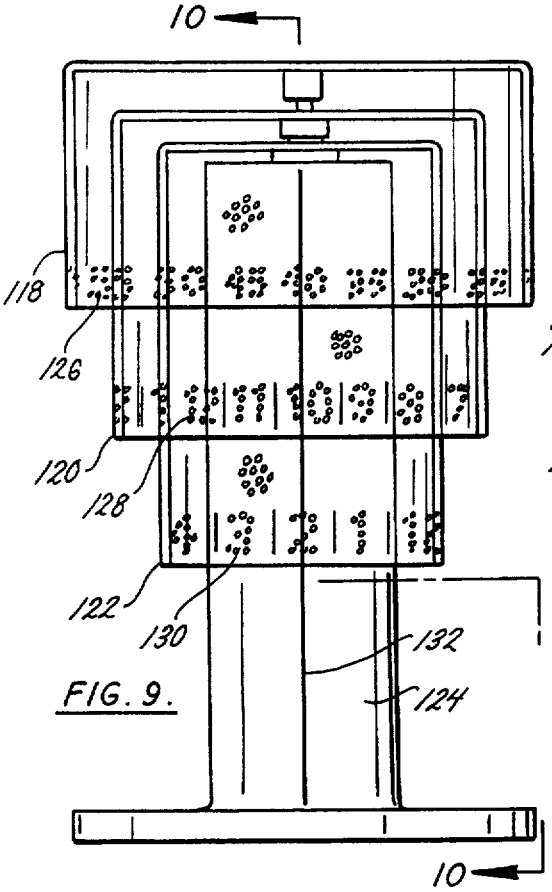
FIG. 9.
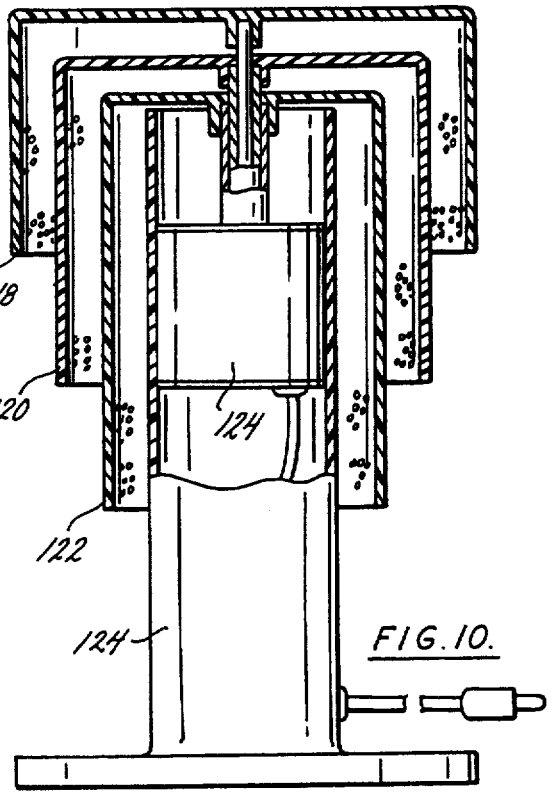
FIG. 10.

STRUCTURAL GRAPHIC DISPLAY

BACKGROUND AND SUMMARY OF THE INVENTION

There are many visual effects which have been created in the prior art for use in structural graphic displays such as greeting cards, desk nameplates, and other ornamental objects such as lamps, vases, or the like. One example is that shown in prior U.S. Pat. No. 3,834,051 which discloses an anamorphic greeting card generally comprised of a mirrored surface placed perpendicular to and in close juxtaposition to another surface on which is printed a distorted anamorphic image. As the card is unfolded and assembled, the image becomes discernible by viewing it in the reflective surface. Thus, this patent teaches the concept of directly viewing a reflective surface to discern an image imprinted on another surface which is out of the line of sight. Still another example is shown in U.S. Pat. No. 4,268,985 which discloses a desk nameplate generally comprised of a right angle glass prism mounted on a mirror, with one of the prism faces being etched with an inverted image such that when the image is viewed in the mirror, the inverted image is righted and is intelligible. With this device, an image is viewed and is discernible in a reflective or mirror surface while the observer looks through an unadulterated or blank prism face. Thus, the observer has a direct line of sight to the mirrored surface for viewing of the image.

The inventor herein has succeeded in designing and developing a structural graphic display which produces an interesting and pleasing visual effect. Essentially, the inventor's concept utilizes a first surface which is generally transparent except that an image is imprinted thereon in reversed format. This first surface is then juxtaposed opposite a second generally reflective surface and oriented such than an observer looks directly through the first generally transparent surface and reversed image into the second generally reflective surface, and the reflection therein, in order to view the corrected image. To enhance this effect, the inventor has found that a number of generally transparent surfaces, each with their own image, may be arranged in a polygon to enclose the space above a second generally reflective surface. When an observer is oriented to directly view the reflective surface in a generally perpendicular line of sight, not only are all of the various images reconstructed in their reflections in a manner which is discernible to the eye, but the geometric shape of the first surfaces is also seen in the reflected image which gives a delightfully pleasing effect of depth. This is especially enhanced by the various angles which the transparent surfaces take with respect to each other, the essence of which is recaptured in their reflection. Upon viewing a structural graphic display of the present invention, the eye is completely fooled into believing that there is a depth beyond the back of the reflective surface. An observer's first reaction is to look behind the reflective surface to ascertain whether such a depth is in existence in reality or only in the mind's eye. Of course, the observer is mildly astonished to find that the feeling of depth is created with no realistic depth being provided by the graphic display.

Not only is this visual effect achievable in the concept of a purely ornamental graphic display, but the inventor has also found that such a graphic display can be incorporated into a light fixture for illuminating a room with indirect lighting. This is achieved by placing a light source on the opposite side of the reflective surface, and making the reflective surface out of a one-way mirror type of material such that light transmits through the reflective surface and the transparent surfaces to display the reversed images on the ceiling and walls. During the day, the light may be switched off and the device once again resembles a structural graphic display.

Still another use which can be made of the inventor's structural graphic display is disclosed in the form of two different kinds of clocks. In one of these, pairs of first and second surfaces are matched and assembled in a generally concentric fashion. Numbers representing the time of day are imprinted on the first surfaces of each pair, with one pair being representative of hours, one of minutes, and the last of seconds. A timepiece movement is then connected to one surface in each of the pairs, with only a small portion of the second surface having reflective material thereon such that as the reflective "patch" is rotated into proper alignment, the correct number is displayed corresponding to the hour, minute, or second, as appropriate.

Still another arrangement for a clock is represented by three cup-like surfaces which are mounted atop each other such that their sidewalls are exposed. In this embodiment, the entire assembly may be supported from a support and a time line indicated on the sidewall of the support such that the numbers which line up with the time line are those which are operative.

In addition to these functional uses, several other graphic ornamental uses are disclosed. These can be incorporated in paper weights, greeting cards, or the like and have uses which are only limited by the creativity of the user.

While the principal advantages and features of the invention have been explained above, a greater understanding of the invention may be attained by referring to the drawings and description of the preferred embodiment which follow.

BRIEF DESCRIPTION OF THE DRAWINGS

FIG. 7 is a front view of a clock incorporating the structural graphic display features of the present invention;

FIG. 8 is a side view of the clock of FIG. 7;

FIG. 9 is a second embodiment of a clock incorporating the structural graphic display features of the present invention; and FIG. 10 is a partial cross-sectional view taken along the plane of line 10—10 and detailing the mounting of the surfaces to the timepiece movement.

DETAILED DESCRIPTION OF THE PREFERRED EMBODIMENT

Figure 1:
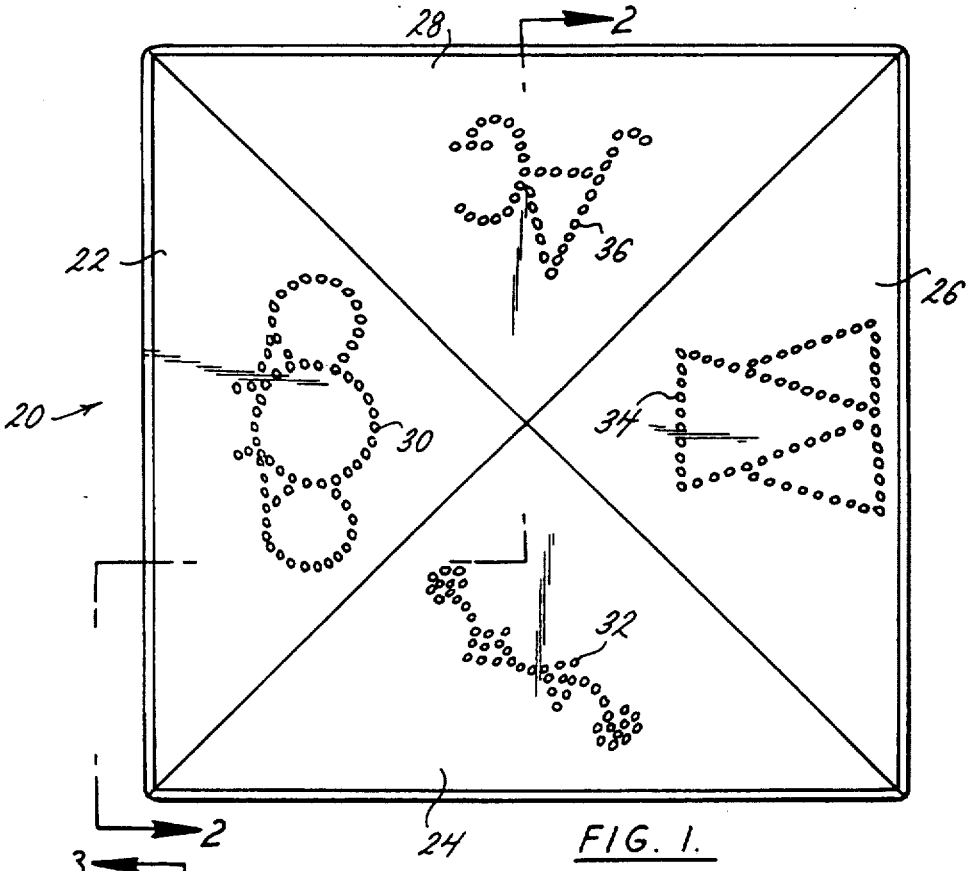
FIG. 1 is a top view of a structural graphic display device of the present invention utilizing four transparent surfaces aligned in a pyramid above a flat reflective surface.
Figure 2:
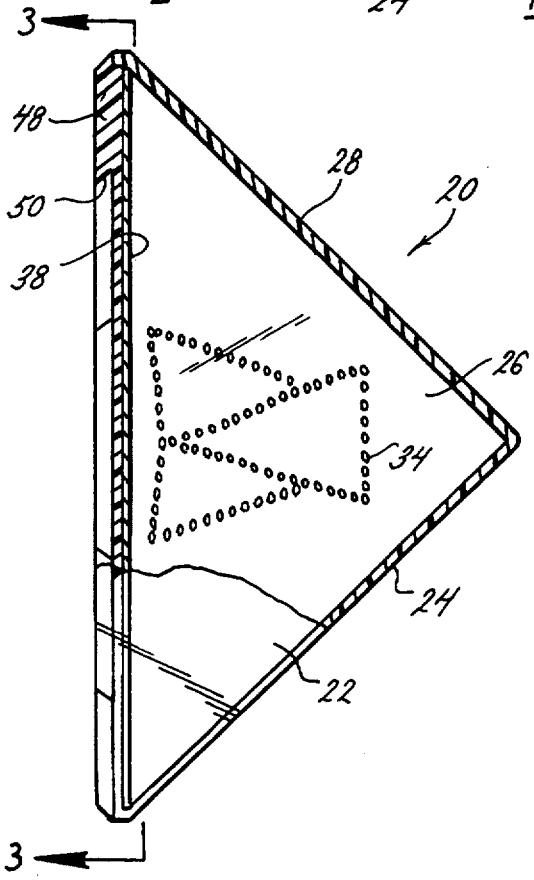
FIG. 2 is a partial cross-sectional view taken along the plane of line 2—2 in FIG. 1 and detailing the construction thereof.
Figure 3:
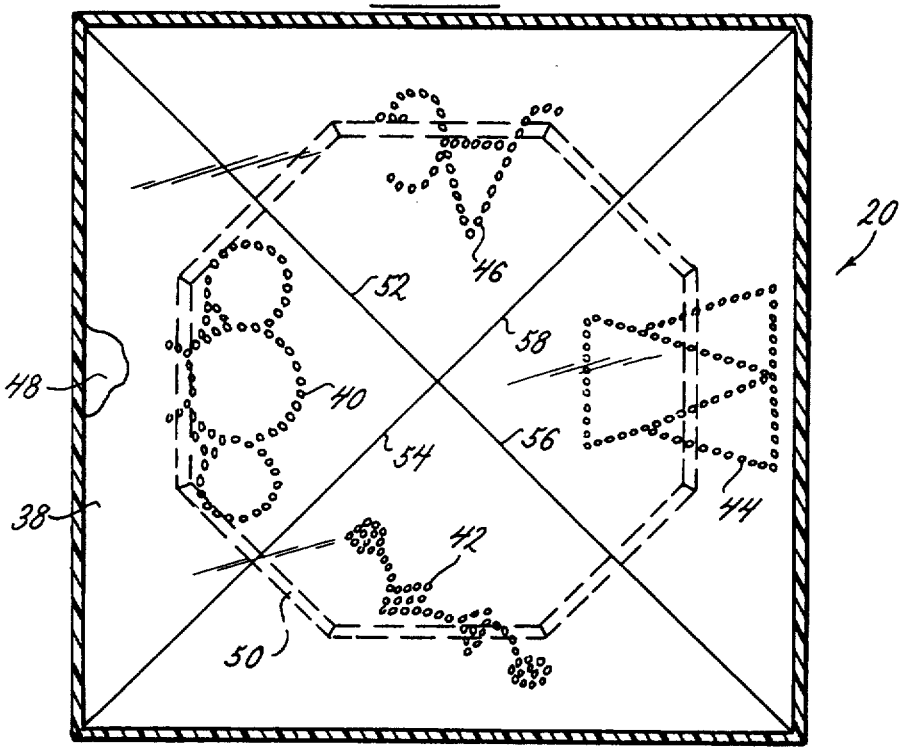
FIG. 3 is a partial cross-sectional view taken along the plane of line 3—3 in FIG. 2 and showing the images as reflected in the reflected surface.

As shown in FIGS. 1–3, the structural graphic display 20 is shown and includes four transparent surfaces 22, 24, 26, 28 each of which has an image 30, 32, 34, 36 imprinted or superposed thereon such that as they are directly viewed, they are reversed. These four transparent surfaces 22–28 are arranged in a polygon, i.e. pyramid, and enclose the space above a generally reflective surface 38. These surfaces may all be formed from Plexiglas, reflective surface 38 being formed from mirrored Plexiglas, with the images 30–36 being silk screened on surfaces 22–28 with an enamel based ink and then washed with a caustic soda bath, rinsed with water, and then edge welded to form the generally pyramid-like structure of the structural graphic display 20. As shown in FIG. 3, the reversed images 30–36 are reflected in reflective surface 38 and appear as images 40, 42, 44, and 46. For convenience, the bottom pedestal 48 may be cut away to form a lip 50 for hanging the graphic display 20 from the wall or the like.

As is apparent by viewing FIGS. 1–3, the structural graphic display 20 produces a reflected image in reflected surface 38 which serves to orient the reversed images 30–36 imprinted on the surfaces 22–28 into their proper and normally expected orientation for viewing, along with the general feeling of depth communicated by the angular orientation of surfaces 22–28 including the weld lines 52, 54, 56, 58 which are also viewed in the reflective surface 38. Hence, when viewed in the proper light and orientation between the observer and the structural graphic display 20, the observer's eye looks past surfaces 22–28, images 30–36, and instead concentrates on the reflected images 40–46 arranged at an angle and in depth with the associated weld lines 52–58.

Figure 4:
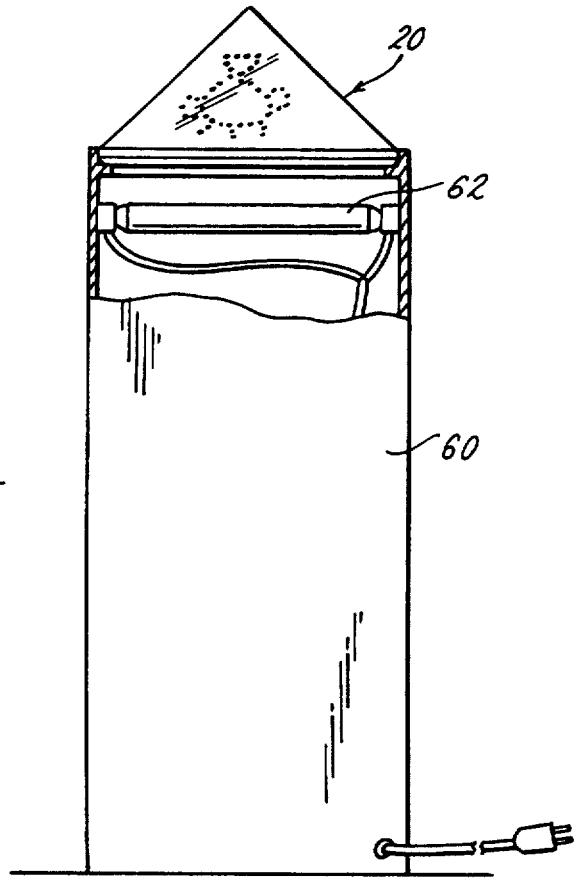
FIG. 4 is a side view of a lamp incorporating the structural graphic device shown in FIGS. 1–3.

As shown in FIG. 4, the structural graphic display 20 may be oriented atop a platform or pedestal 60 and a light 62 positioned directly beneath the structural graphic display 20 such that light emanating from source 62 shines through the reflective surface 38, transparent surfaces 22–28, and projects the images 30–36 on the walls and ceiling of a room. This can provide an indirect lighting which can be quite pleasing as the images 30–36 can become distorted to such an extent as to be unrecognizable. Thus, the people in the room do not focus on the reversed images which are distorted and instead appreciate the background lighting as merely that. Of course, light source 62 may be turned off and the structural graphic display 20 viewed in the normal manner as explained above.

Figure 5:
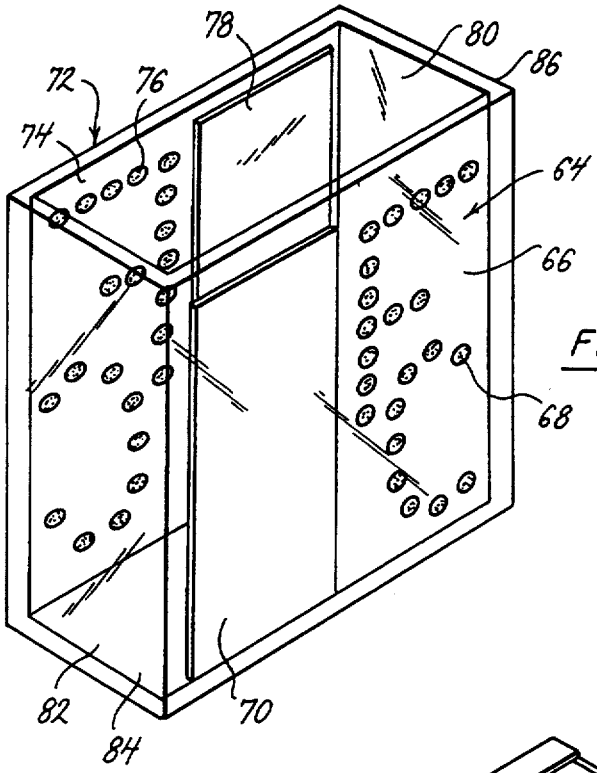
FIG. 5 is a perspective view of another embodiment of a structural graphic display device incorporating panels having first and second surfaces in the same panel.

In an alternate embodiment as shown in FIG. 5, a first panel 64 has a first surface 66 with a reversed image 68 superposed thereon along with a second reflective surface 70. Similarly, a second panel 72 includes a first surface 74 with a reversed image 76 imprinted thereon and a reflective second surface 78. Thus, an observer to the right of the embodiment shown in FIG. 5 or to the left of the embodiment as shown in FIG. 5 is capable of viewing an image reproduced with the technique of the present invention. Additionally, four blank panels 80, 82, 84, 86 enclose the two panels 64, 72 and create a rectangular solid to maintain panels 64 and 72 in proper juxtaposition. The embodiment as shown in FIG. 5 could be an ornamental display device for an office worker's desk or the like.

Figure 6:
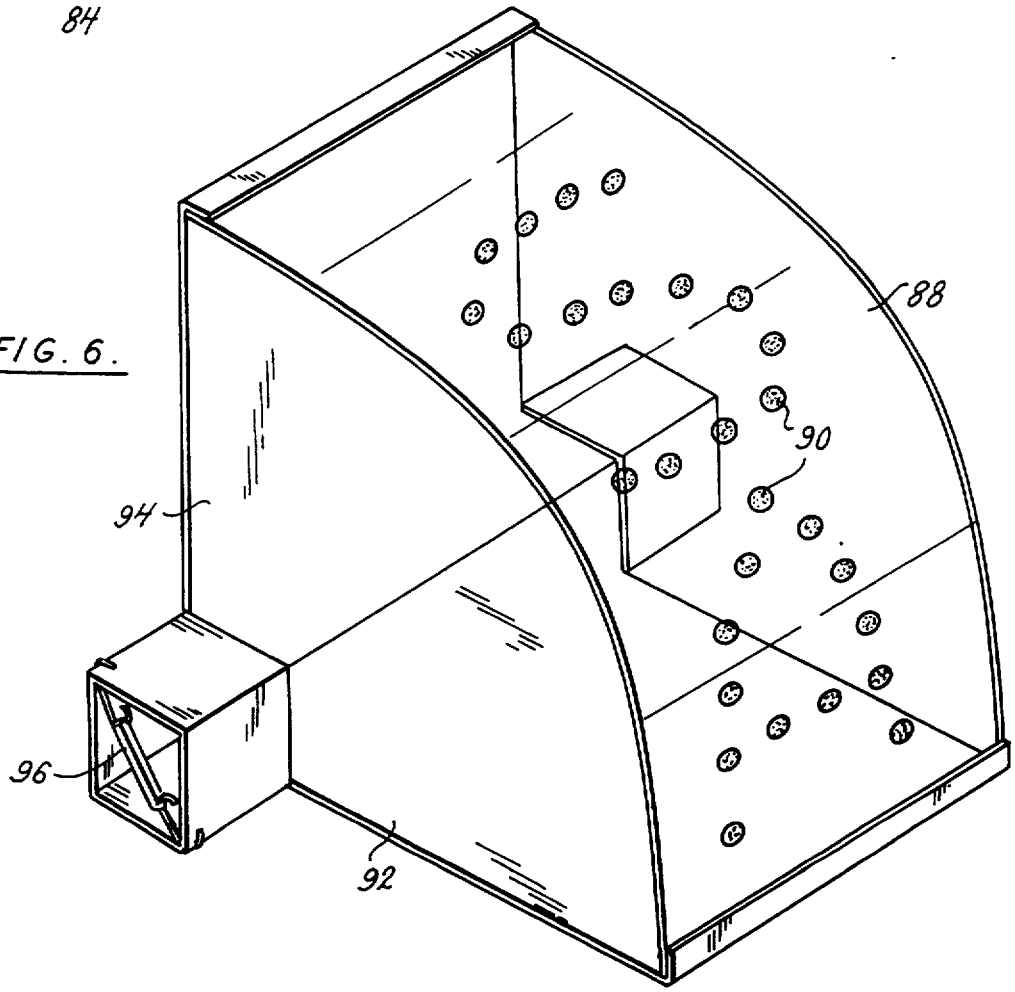
FIG. 6 is a perspective view of a greeting card device having an arcuate first surface aligned with a pair of perpendicularly oriented second surfaces.

As shown in FIG. 6, still another embodiment includes a first transparent surface 88 with a reversed image 90 imprinted thereon and curved between the edges of two generally perpendicularly aligned reflective surfaces 92, 94. A rubber band and hook arrangement 96 can be used to pop open and maintain the embodiment as shown in FIG. 6 in its aligned orientation, thereby making it particularly suitable for use as a greeting card or the like. In addition to the creation of a reflected image as described with the earlier embodiments, it is also possible to invert the image 90 from top to bottom as the perpendicularly aligned surfaces 92, 94 serve to double reflect reversed image 90.

As shown in FIGS. 7 and 8, a clock may be created using the structural graphic display technique disclosed herein. As shown in FIGS. 7 and 8, three pairs of surfaces 98, 100, and 102 are oriented such that the images 104, 106, and 108 are viewable at the outer edges of each of the pairs 98, 100, 102. In operation, a timepiece movement 110 rotates the inner, reflective surface of each of pairs 98, 100, 102 and each of the inner, reflective surfaces have only a single reflective patch 112, 114, 116 such that only a single number in the images 104, 106, 108 is displayed in a reflected surface and becomes viewable. As shown in FIG. 7, the time represented is 3:20 and 30 seconds.

In still another embodiment of a clock as shown in FIGS. 9 and 10, three cup-like surfaces 118, 120, 122 are mounted atop a pedestal support 124 and contain a series of images 126, 128, 130 representative of the time of day. A time line or hash mark 132 directs the viewer's eye to only three of the numbers contained in images 126–130 in order that the time may be read as the surfaces 118, 120, 122 are rotated by a timepiece movement 134. As is apparent from viewing FIGS. 9 and 10, a band of reflective surface is applied to that surface directly beneath the images 126–130 in order that they may be viewed using the principles of the present invention. Thus, the first and second surfaces for different pairs may be on the same cup-like surface 118–122.

There are various changes and modifications which may be made to the invention as would be apparent to those skilled in the art. However, these changes or modifications are included in the teaching of the disclosure, and it is intended that the invention be limited only by the scope of the claims appended hereto.

What is claimed is:

1. A structural graphic display, said display comprising a first surface, said first surface being substantially transparent, an image superposed on said first surface, said image being reversed when viewed directly and thus tending to be unrecognizable, a second surface, said second surface being substantially reflective, the first surface being juxtaposed to the second surface so that the reflection of said reversed image in the second surface is viewable through the first surface, the image being thereby discernible by an observer looking through the transparent first surface and reversed image and recognizing the image as a reflection in the reflective second surface.

2. The device of claim 1 further comprising a plurality of transparent first surfaces, each of said first surfaces having a reversed image superposed thereon, and all of said first surfaces being juxtaposed with respect to the second surface for viewing therein.

3. The device of claim 2 wherein said plurality of first surfaces are oriented into a polygon, said polygon having the second surface as its base.

4. The device of claim 3 wherein the planar orientation of said first surfaces, as well as their respective images, is viewable as a reflection in the second surface.

5. The device of claim 4 wherein said polygon is a pyramid comprised of four first surfaces and a second surface as the base thereof.

6. The device of claim 4 wherein the reflecting second surface is transparent to light emanating on the side opposite the first surfaces, and further comprising a light source positioned on said transparent side so that reversed images are projected through said first surfaces to an observer or display surface.

7. The device of claim 3 wherein said first surfaces fully enclose the space above said second surface.

8. The device of claim 1 further comprising a first panel and a second panel, said panels each comprising a first surface and a second surface, said panels being juxtaposed so that said first and second surfaces are juxtaposed for viewing of an image from either of two opposing sides of said panels.

9. The device of claim 8 wherein each of said panels has four sides and further comprising four blank panels, said blank panels joining the sides of said first and second panels to thereby form a cube.

10. The device of claim 1 wherein said display further comprises a plurality of matched pairs of first and second surfaces, said images imprinted on said first surfaces being representative of the time of day, and a timepiece movement connected to said matched pairs so that said device displays the time of day.

11. The device of claim 10 wherein said matched pairs of first and second surfaces comprise concentrically mounted circular discs, with each of said pairs having a different diameter so that as the pairs overlie each other the images of the smallest pair are directly visible and those of larger pairs are visible beyond the periphery of the next smaller pair.

12. The device of claim 11 wherein the second surface of each pair has only a portion thereof of sufficient reflectivity to display the image so that only a portion of the image is viewable at any point in time.

13. The device of claim 12 wherein the time representative images comprise the numbers necessary to display the time of day and the reflective portion of each pair is sufficiently sized to display only one number.

14. The device of claim 10 wherein said matched pairs are cylindrical cups of varying diameter and sidewall length, said cups being nested atop each other so that the images on the largest diameter pair are directly visible and those of smaller diameter pairs are visible beneath the sidewall of the next larger diameter pair.

15. The device of claim 14 wherein the second surface of each pair has only a portion thereof of sufficient reflectivity to display the image so that only a portion of the image is viewable at any point in time.

16. The device of claim 15 wherein the time representative images comprise the numbers necessary to display the time of day and the reflective portion of each pair is sufficiently sized to display only one number.

17. The device of claim 14 further comprising a support on which said pairs are supported, and a marker on said support to indicate which of the time representative numbers are operative.

18. A structural graphic display, said display comprising a first surface, said first surface being substantially transparent, an image superposed on said first surface, said image being reversed when viewed directly and thus tending to be unrecognizable, a second surface spaced apart from said first surface, said first and second surfaces being separated by a gaseous interface such as air or the like, said second surface being substantially reflective, the first surface being juxtaposed to the second surface so that the reflection of said reversed image in the second surface is viewable through the first surface, the image being thereby discernible by an observer looking through the transparent first surface and reversed image in recognizing the image as a reflection in the reflective second surface.

* * * * *